United States Patent [19]

Fidi et al.

[11] Patent Number: 4,508,192

[45] Date of Patent: Apr. 2, 1985

[54] MICROPHONE DIAPHRAGM

[75] Inventors: Werner Fidi, Baden; Richard Pribyl, Vienna; Konrad Wolf, Bad Vöslau, all of Austria

[73] Assignee: AKG Akustische u.Kino-geräte gesellschaft mbH, Austria

[21] Appl. No.: 479,143

[22] Filed: Mar. 28, 1983

[30] Foreign Application Priority Data

Apr. 8, 1982 [AT] Austria ..... 1402/82

[51] Int. Cl.[3] ..... H04R 7/06

[52] U.S. Cl. ..... 181/158; 181/167

[58] Field of Search ..... 181/157, 160, 161, 164, 181/165, 168, 170, 167, 158, 172, 174, 173, 137, 132

[56] References Cited

U.S. PATENT DOCUMENTS 1,696,949 1/1929 Grass ..... 181/172

4,343,376 8/1982 Tsukagoshi et al. ..... 181/167

*Primary Examiner*—L. T. Hix

*Assistant Examiner*—Brian W. Brown

*Attorney, Agent, or Firm*—McGlew and Tuttle

[57] ABSTRACT

A diaphragm for electrostatic and electrodynamic microphones which has a distinct directional pattern comprises a taut diaphragm having a thickness of less than 8 microns and a diameter of 10 millimeters at most and which is made of an elastically extensible rubber base material which has a natural frequency of 1,200 Hz to 1,500 Hz at most. A diaphragm is particularly for microphones of the cardioid, supercardioid and hypercardioid and figure eight type.

7 Claims, 4 Drawing Figures

MICROPHONE DIAPHRAGM

FIELD AND BACKGROUND OF THE INVENTION

This invention relates in general to diaphragms for microphones and in particular to a diaphragm for electrostatic and electrodynamic microphones which have a distinct directional pattern.

German Pat. No. 452,961 discloses a so-called resonance-free diaphragm designed as a unstretched or non-taut skin of rubber or the like, to which carbon grains of various size are fixed by an adhesive. The indicated thickness of the rubber skin is 0.1 mm. Such a diaphragm is usable only for carbon microphones. German OS No. 30 11 056 deals with a molding material allegedly suitable also for diaphragms of electroacoustic transducers. More particularly, this prior art molding material is a mixture of plastics to which acrylnitrile-butadiene rubber (about 20% of the total mass) may be admixed. Since even pickup arms, housings, etc. may be formed from this material, no elastic diaphragm material is concerned. It is therefore impossible in practice to make electrostatic or electrodynamic microphones of the above-mentioned kind with the above prior art diaphragms. In German Pat. No. 452,961, the diaphragm is usable only in carbon microphones while in the other reference, the molding material is suitable only for loudspeaker diaphragms.

SUMMARY OF THE INVENTION

The invention is directed to microphones having a particular directional characteristic and equipped with a diaphragm of improved construction. With the sound incoming frontally at right angles to the microphone, these microphones have an exclusively horizontal frequency response in the audible range of 20 Hz to 20 kHz.

Pressure-gradient receivers, however, with one of the above-mentioned directional patterns, require diaphragms having different acoustic properties, depending on whether they are electrostatic or electrodynamic. Electrostatic microphones need a diaphragm having a natural frequency between 1,000 Hz and 1,500 Hz. In electrodynamic microphones, a satisfactory frequency response requires a diaphragm with a natural resonance frequency at the lower end of the frequency range to be transmitted. In addition, a very small mass and a very small modulus of elasticity of the diaphragm are required. A small diaphragm mass is further needed for extending the transmission range of electrostatic microphones to the highest frequencies to be transmitted with the microphone. Moreover, a smaller diaphragm mass reduces the sensitivity of the microphone to mechanical vibrations and shock-like impacts and blows.

In electrostatic microphones, also known as condenser microphones, diaphragms made from thin polyester or polycarbonate foils have been used, having a thickness of 3 to 6 microns. Such plastic foils are stamped in patterns, to reduce their bending strength and increase their flexibility. The modulus of elasticity, as a measure of the elasticity of the material, of the plastic foils is about $0.002 \cdot 10^{5 N/mm^2}$. With this kind of diaphragm, diaphragm resonance frequencies of about 1,500 Hz can be obtained only with diaphragm diameters not smaller than 15 mm. In diaphragms of lesser diameter, the resonance frequency increases approximately linearly with the decreasing diameter, so that in diaphragms having a diameter below 10 mm, the freqency exceeds 2,000 Hz. However, in directional condenser microphones having a diaphragm resonance frequency exceeding 2,000 Hz, the level drops continually in the low frequency range, and this drop may amount to 20 db at 100 Hz relative to the 1,000 Hz level. This is a substantial limitation to the transmission range and thus an impairment of the transducer function.

Very thin plastic foils, primarily foils of polycarbonate under 8 microns of thickness, have a non-homogeneous microstructure caused by the manufacturing process and manifested by an unsymmetrical crystalline aspect of the stretched foil. In consequence, the modulus of elasticity varies in the various directions in the plane of the material. This means that such a foil, when employed for a diaphragm in an electroacoustic transducer, will have unequal tensile strengths in different directions and there will be no uniform internal stress $\sigma$ (sigma) for all directions. Such an irregular internal stressing of the diaphragm may cause asymmetries in the directional pattern of the microphone. In other words, the directional pattern of a rotationally symmetrical microphone having a diaphragm in which stresses are oriented irregularly, is not rotationally symmetrical, and the directional patterns in the individual meridional planes are not congruent. This is a great disadvantage affecting the quality of reception of the microphone.

The same applies to electrodynamic microphones, and quite particularly to orthodynamic ones, having conducting tracks applied to the diaphragm surface. With these microphones, however, the requirement of a low natural resonance frequency of the diaphragm having a very small diameter is much more critical, since this frequency must be at the low frequency end of the transmission range, thus at about 150 Hz.

The invention is directed to a diaphragm having no such disadvantages. To this end, a diaphragm is provided which is made of a rubber-base elastically stretchable material and has a natural resonance frequency of from 1,200 Hz to 1,500 Hz at most.

The advantage of such material is that the modulus of elasticity thereof is smaller than that of the hitherto used polyester or polycarbonate foils, and that at the same time, due to its high flexibility, the oscillating diaphragm is well damped. The very low modulus of elasticity of rubber-base base materials makes it possible to manufacture very thin diaphragms, with diameters of less than 10 mm, having an extremely small mass and a natural resonance frequency below 1,200 Hz. Therefore, a directional condenser microphone can now be manufactured having a horizontal frequency characteristic in the frequency range of 20 Hz to 20 kHz, and minimized dimensions which are far below those hitherto known in the assortment of condenser microphones of equal quality.

A great advantage is further the greater expansibility of rubber as compared with plastic foils, the respective ratio being up to 400%, to about 10%. Another advantage is the excellent directional homogeneity of rubber permitting to manufacture microphone diaphragms in which equal internal stresses develop in every direction, so that in a circular diaphragm, for example, firmly secured all around the edge, always the same internal stress $\sigma$ (sigma) is obtained in any radial direction. A diaphragm thus clamped oscillates so uniformly that the directional pattern of the microphone is strictly axially symmetrical, which could not be achieved with the use of conventional microphone diaphragm materials. The very substantial advantage of a small bending strength of diaphragms made of rubber-base materials manifests itself in a substantially more homogeneous oscillation of the diaphragm at high frequencies, which primarily results in a smooth frequency response. Notwithstanding the hitherto mentioned advantages, quite particular attention must be drawn to the fact that the extent of linear distortions of the sound fields is determined by the external dimensions of the microphone. For example, at low frequencies, sound diffraction occurs around the microphone, while at high frequencies, the dynamic pressure rises. In microphones in accordance with the invention, such sound distortions occur outside the audible range, thus above 20 kHz if a microphone diameter is equal to or less than 6 mm. The miniaturization of the microphone also makes it less conspicuous on stages, in television pictures, meeting, news coverages, and similar applications, not the least while wearing them as a Lavalier microphone which, just for such applications, may be designed as a directional microphone.

In the invention, the use of chloroprene rubber, neoprene rubber, silicone rubber, or natural rubber has proved particularly advantageous. For electrostatic microphones requiring a diaphragm with some electrical conductivity, it is advisable to make the rubber-base diaphragm material sufficiently conducting by admixing metal powder or carbon black. However, the taut or stretched diaphragm may also be provided with an electrically conducting coat, in an evaporation or sputtering process, or by applying a lacquer. Experience has shown that the inventive diaphragm can advantageously be made electrically conducting, in various relatively inexpensive ways, to an extent suitable for being used in electrostatic microphones.

Another advantage of the diaphragm materials provided by the invention is that they may be made with a great internal friction, which optimizes the damping of the partial oscillations. Butyl rubber has proved particularly suitable in this regard.

Accordingly it is an object of the invention to provide a diaphragm for electrostatic and electrodynamic microphones which has a distinct directional pattern and which comprises a taut diaphragm having a thickness of less than 8 microns and a diameter of less than 10 millimeters which is made of elastically extensible rubber base material having a natural resonance frequency of 1,200 to 1,500 Hz.

A further object of the invention is to provide a diaphragm for a microphone which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings in which preferred embodiments of the invention are illustrated.

GENERAL DESCRIPTION OF PREFERRED EMBODIMENTS

Figure 1:
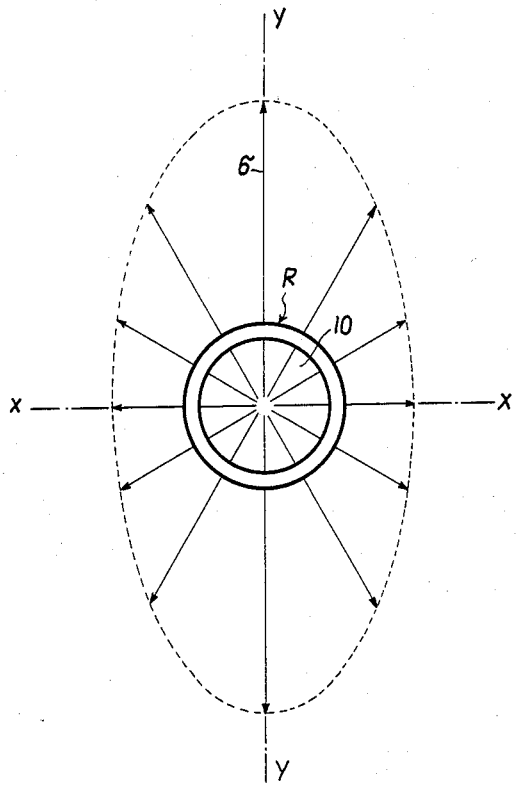
FIG. 1 (PRIOR ART)
FIG. 1 is a stress diagram of a prior art diaphragm having its direction-dependent modulus of elasticity.

FIG. 1 shows the stress field of a diaphragm 10 clamped in a ring R, such as will develop in a taut foil of plastic in planes parallel to the surface of the foil. There are two privileged directions perpendicular to each other, in which the smallest and highest internal stresses ($\delta$), respectively, appear. In the directions therebetween, the stress sigma continuously increases or diminishes, depending on the starting preferential direction, so that, for example, an ellipse forms the locus for all the stress vectors.

Figure 2:
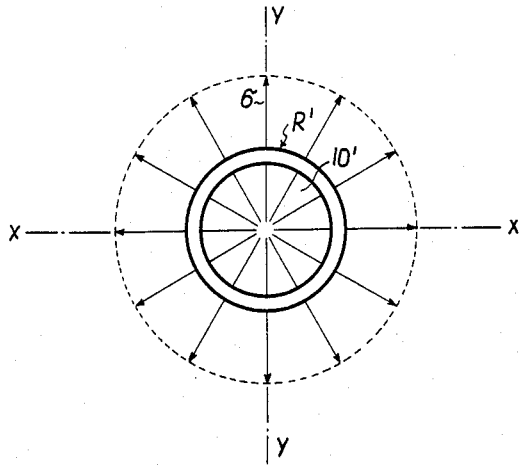
FIG. 2 is a similar diagram of an inventive diaphragm having its modulus of elasticity independent of the direction.

FIG. 2 shows the stress field in a diaphragm 10' which again is prestressed and clamped in a ring R', but which is made of a material in accordance with the invention. Due to the homogeneous structure of the material of diaphragm 10' having a modulus of elasticity independent of the direction, no direction is preferential. The stress $\sigma$ is constant for all directions.

Figure 3:
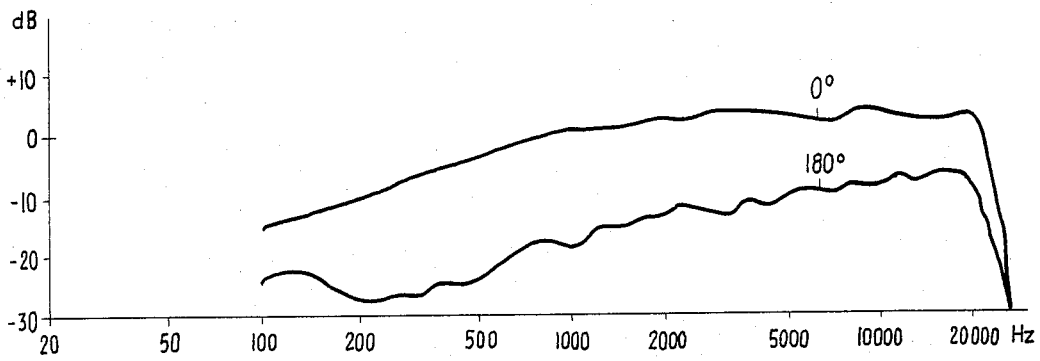
FIG. 3 shows the frequency response of a condenser microphone with a diaphragm of plastic having a natural resonance frequency above 2,000 Hz.

FIG. 3 shows a frequency response of a condenser microphone with a diaphragm diameter of less than 10 mm, whose diaphragm is made of a conventional plastic having a modulus of elasticity permitting a natural resonance only in a region far above 2,000 Hz. The frequency characteristic shows that below 1,000 Hz the sensitivity of the microphone continually decreases so that this frequency range, which is very important within the audible frequencies, is transmitted poorly or even not at all.

Figure 4:
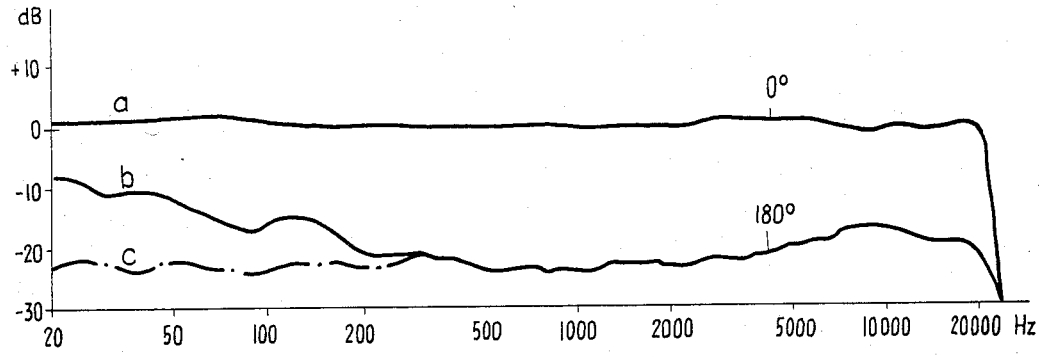
FIG. 4 shows the frequency response of a condenser microphone with a diaphragm in accordance with the invention having a diaphragm frequency between 1,500 Hz and 2,000 Hz.

The frequency response of a condenser microphone equipped with an inventive diaphragm having a smaller diameter than 10 mm is shown in FIG. 4. According to curve a, the characteristic is largely horizontal between 20 Hz and 20 kHz, because the resonance of the diaphragm lies between 1,000 Hz and 1,500 Hz. This is due to the inventive diaphragm which has a substantially smaller modulus of elasticity than the hitherto used materials. The transmission of such a microphone is very satisfactory, since over the entire range of audible frequencies, the conversion factor remains constant for all transmitted frequencies. Curves b and c, representing the backward damping at a distance of 1 meter (curve b, spherical sound field), and in a planar sound field (curve c), show that the directional pattern is thereby not affected.

The same figures illustrate an application of the described diaphragm to an orthodynamic microphone, only it must be taken-into account that for this purpose, the diaphragm resonance must lie at about 150 Hz. Below this resonance frequency the frequency characteristic drops by 12 db per octave.

While specific embodiments of the invention have been shown and described in detail to illustrate the application of the principles of the invention, it will be understood that the invention may be embodied otherwise without departing from such principles.

What is claimed is:

1. A diaphragm for electrostatic and electrodynamic microphones which has a distinct directional pattern, comprising a prestressed diaphragm having a thickness of less than 8 microns and a diameter of less than 10 millimeters and being made of an elastically extensible rubber-base material having a natural frequency in the range of from 1,200 to 1,500 Hz.

2. A diaphragm according to claim 1, wherein said diaphragm is used for a condenser microphone, said rubber-base material of said diaphragm including additive making it conductive.

3. A microphone according to claim 2, wherein said additive comprises a metallic powder.

4. A microphone according to claim 2, wherein said diaphragm material includes a soot.

5. A diaphragm according to claim 1, wherein said elastically extensible rubber-base material includes a metal coated thereon by evaporation.

6. A diaphragm according to claim 1, wherein said elastically extensible rubber-base material comprises butyl rubber material having a strong internal friction.

7. A diaphragm according to claim 1, wherein said diaphragm is made of a material selected from the group consisting of: chloroprene rubber; neoprene rubber; silicone rubber; natural rubber.

* * * * *